US005683309A

United States Patent [19]

Reimers

[11] Patent Number: 5,683,309

[45] Date of Patent: Nov. 4, 1997

[54] ADJUSTABLE BALANCE WEIGHTING SYSTEM FOR GOLF CLUBS

[76] Inventor: Eric W. Reimers, 1235 Starwood, Missoula, Mont. 59802

[21] Appl. No.: 541,026

[22] Filed: Oct. 11, 1995

[51] Int. Cl.[6] ..... A63B 53/04

[52] U.S. Cl. ..... 473/337; 473/339; 473/341; 473/350

[58] Field of Search ..... 473/288, 291, 473/312, 325, 334, 335, 336, 337, 338, 339, 350, 341

[56] References Cited

U.S. PATENT DOCUMENTS

| | | | |
|---|---|---|---|
| 1,575,364 | 3/1926 | Hodgkins | 473/337 |
| 2,460,445 | 2/1949 | Bigler | 473/336 |
| 3,199,874 | 8/1965 | Blasing | 473/335 |
| 3,979,122 | 9/1976 | Belmont | 473/336 |
| 4,145,052 | 3/1979 | Janssen | 473/338 |
| 4,411,430 | 10/1983 | Dian | 473/337 |
| 4,607,846 | 8/1986 | Perkins | 473/336 |
| 4,867,458 | 9/1989 | Sumikawa et al. | 473/336 |
| 5,275,413 | 1/1994 | Sprague | 473/337 |
| 5,429,356 | 7/1995 | Dingle | 473/334 |

FOREIGN PATENT DOCUMENTS 797815 5/1923 United Kingdom .

*Primary Examiner*—Sebastiano Passaniti
*Assistant Examiner*—Stephen L. Blau
*Attorney, Agent, or Firm*—Michael J. Hughes; Mark E. Baze

[57] ABSTRACT

An adjustable balance weighting system (10) is provided for adjusting the weighting and balance of a golf club of either the "iron" or the "wood" type in order to encourage the golf club to be in tune with the golfer's swing and/or to correct any deficiencies that may exist therein. An eccentrically weighted balancing disk (32 or 82) is mounted on or in the club head (14 or 74) so as to be rotatable about a first Allen screw (60 or 84) and provides a mechanism by which the center of mass, and therefore the sweet spot, of the club head (14 or 74) may be varied. In the case of an iron-type club head (14), the balancing disk (32) is mounted in a substantially vertical orientation in a cavity (30) on a cavity back wall surface (40) at the rear face (24) of the club head (14). In the case of a wood-type club head (74), the balancing disk (82) is mounted in a horizontal orientation in a recess (80) in the top surface (78) of the club head (74). When adjustment is needed, a second Allen screw (68 or 86) is conveniently loosened so that the balancing disk (32 or 82) may pivot and be turned to a desired orientation, thereby causing more weight to be transferred to either the toe or heel of the club head (14 or 74), as necessary, to correct a "slice" or a "hook," respectively. Provision is also made for the use of the adjustable balance weighting system (10) in the context of the "fitting" of golf clubs so that a permanent adjustment is made.

13 Claims, 5 Drawing Sheets

ADJUSTABLE BALANCE WEIGHTING SYSTEM FOR GOLF CLUBS

TECHNICAL FIELD

The present invention relates generally to golf clubs, and more particularly to golf club heads having an adjustable weighting system for customizing the weight and balance of the golf clubs.

BACKGROUND ART

As anyone who has ever played and enjoyed the game of golf can relate, the sport has a great propensity to both simultaneously enthuse and frustrate. The seemingly simple task of swinging a golf club and hiring a golf ball is not at all simple, and in fact, the dynamics of properly hitting a golf ball are quite complex. The most desirable ball flight characteristics generally occur when the golf ball is struck with the "sweet spot" on the face of the club head, maximum impact and true flight occurring at that location. For a variety of reasons, it is often extremely difficult for a golfer to overcome his or her propensity to strike the golf ball at a point on the club head face that is not in alignment with the sweet spot, or center of mass of the club head. Even the best golfer may be unable to overcome a particular glitch in his or her swing that causes a recurring "hook" or "slice" or other unwanted ball trajectory, and it is especially true that the typical golfer will tend to "pull" (hook) the ball with the shorter clubs and slice with the longer ones. And even where the one problem is solved, another invariably rises to take its place. The foregoing is evidenced in the great inconsistency with which professional golfers win tour competitions, as well as in the rise of high-tech services that offer sophisticated sensor feedback and computer analysis in order to assist a golfer in correcting a problematic swing.

A number of prior attempts have been made in an effort to increase a golfer's ability to properly hit a golf ball. A common focus has been on the re-distribution of weight across the back of the golf club head. So-called "perimeter weighting" provides a larger sweet spot and thus tends to be more forgiving when the ball is not struck in precise alignment with the center of mass of the club head. In addition to perimeter weighting, however, it is desirable to be able to change (move) the actual center of mass and, therefore, the sweet spot of the club head. Towards this end, a number of designs for weight balancing a club head have been proposed. Some of these designs, such as that shown in U.S. Pat. No. 5,026,056 issued on Jun. 25, 1991 to McNally et al., incorporate integral, fixed or otherwise permanent weights that are positioned to provide a sweet spot that correlates with the visual center of the club face. Such a design, while to some extent a helpful assist, is inflexible and does not permit the weighting of the club to be tuned to the swing of the individual golfer. And even where a fixed-weight club is customized for the individual, as noted, a golfer's swing is generally not a static phenomenon but rather changes, if only for temporary, frustrating periods of time.

Much better, then, are designs that permit adjustable weight balancing. A number of patents have issued for weighting schemes that share in common the characteristic of employing chambers that are drilled or hollowed at various angles into either an iron or a wood club head. See for example U.S. Pat. No. 4,867,458 issued on Sep. 19, 1989 to Sumikawa et al., U.S. Pat. No. 4,607,846 issued on Aug. 26, 1986 to Perkins, U.S. Pat. No. 4,145,052 issued on Mar. 20, 1979 to Janssen et al., and U.S. Pat. No. 3,979,122 issued on Sep. 7, 1976 to Belmont. A weight, in the form of a threaded screw, plug or metal powder, is inserted into a chamber and positioned to achieve the desired weighting and balance. These methods are clumsy and awkward to implement, and achieving a proper adjustment is not intuitively simple. The latter is especially true in light of the fact that it would appear to be difficult for the golfer to tell by visual observation alone the degree or extent to which any adjustment has been made by the aforementioned methods, the positioning of the weights being made within hidden recesses and/or there being no simple guide or reference markers that can be employed during adjustment.

Because of the limitations associated with most presently available golf clubs, a substantial need still exists for a golf club that provides for an intuitively simple, efficient and easy method of weight balance adjustment.

DISCLOSURE OF THE INVENTION

Accordingly, it is an object of the present invention to provide a golf club head having an improved mechanism for adjusting the weight and balance thereof.

It is another object of the invention to provide a golf club head with a method of adjusting the weight and balance that is simple and easy.

It is a further object to provide a golf club head in which the sweet spot may be adjusted to correlate with a golfer's particular swing pattern and/or with the apparent visual center of the golf club face.

It is yet another object to provide for an adjustable balance golf club head in which adjustments in the weight and balance may be made in small, precise increments.

It is yet a further object to provide a method of adjusting the weighting and balance of a golf club that it applicable to a wide variety of golf clubs.

It is still another object of the present invention to provide an adjustable balance golf club that may be used as a "fitting" club.

Briefly, the preferred embodiment of the present invention is a system for adjusting the weighting and balance of a golf club head of either the "iron" or the "wood" type. An eccentrically weighted balancing disk is mounted on (or in) the club head so as to be rotatable and provides a mechanism by which the center of mass, and therefore the sweet spot, of a club head may be varied. In the case of an iron, the balancing disk is mounted in a substantially vertical orientation in a recessed fashion on the back of a club head having, in preferred form, perimeter weighting. In the case of a wood, the balancing disk is mounted in a horizontal orientation in a recess in the top surface of the club head or in an internal cavity within the club, with an access aperture being provided therefor. When adjustment is needed, an Allen screw is conveniently loosened so that the balancing disk may pivot and be turned to a desired orientation, thereby causing more weight to be transferred to either the toe or heel of the club head, as necessary, to cause the golf club to be in tone with the golfer's swing and/or to correct any deficiencies that may exist therein.

An advantage of the present invention is that adjustment using the weight balancing system is intuitively simple.

Another advantage of the invention is that adjustment of the balance and weighting of the golf club may be easily and rapidly carded out even during actual play on a golf course, although it is intended that this feature may be disabled in order to comply with competitive rules, once the optimum position for the golfer has been established.

A further advantage is that the weighting and balancing system may be adapted to the personal swing and style of essentially any golfer.

Yet another advantage is that the invention is adaptable to virtually any type of golf club.

Yet a further advantage of the present invention is that modifying the balance and weighting of a golf club is so facile as to encourage the regular and consistent use thereof.

Still another advantage is that where an easy adjustability is not desired or permitted (perhaps in U.S.G.A. play, for example), the golfer may be fitted using a golf club of the present invention in which subsequent to the fitting the balancing adjustment achieved thereby may be simply and easily made to be permanent.

These and other objects and advantages of the present invention will become clear to those skilled in the art in view of the description of the best presently known mode of carrying out the invention as described herein and as illustrated in the several figures of the drawings.

BEST MODE FOR CARRYING OUT THE INVENTION

Figure 1:
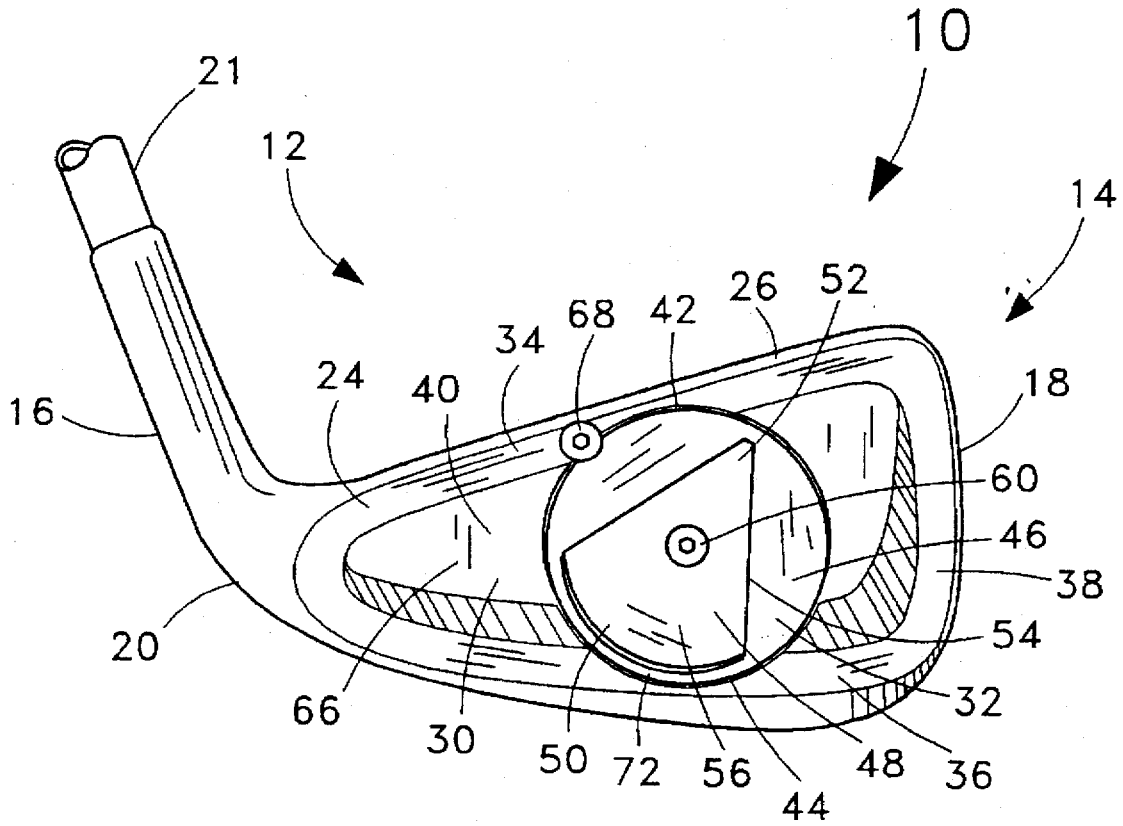
FIG. 1 is a rear elevational view of an iron-type club head of the preferred embodiment of the present invention.

The preferred embodiment of the present invention is an adjustable balance weighting system for a golf club head. The weighting system of the preferred embodiment is applicable to golf clubs of both the iron and the wood type and is set forth in FIGS. 1 and 6 of the drawings, where it is designated therein by the general reference character 10.

Figure 2:
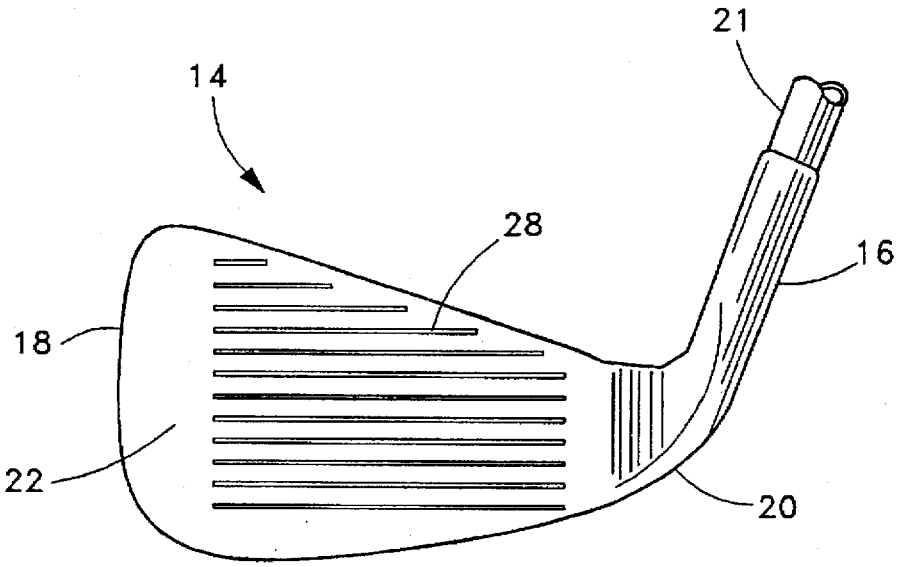
FIG. 2 is a front elevational view of the club head of FIG. 1.
Figure 3:
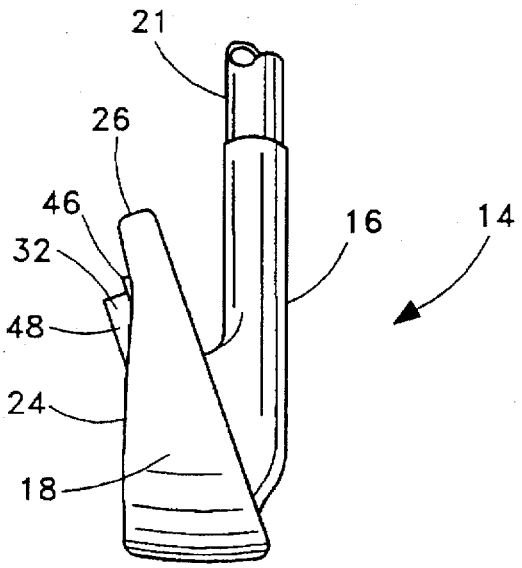
FIG. 3 is a toe end elevational view of the club head of FIG. 1.

Referring initially to the rear and front elevational views in FIGS. 1 and 2, respectively, a typical golf club 12 is shown having an iron-type club head 14. The club head 14 has a hosel 16 formed integrally therewith and also includes a toe end 18 and a heel end 20. The lower end of a shaft 21 is connected to the hosel 16 in the usual manner. Extending longitudinally between the toe end 18 and the heel end 20 are a planar striking face 22, a rear face 24, and a narrow top surface 26. The striking face 22 is typically scored in conventional fashion with horizontal parallel lines 28. As is evident in the toe end view of FIG. 3, the striking face 22 slopes upwardly and rearwardly to form a loft angle, a different loft angle being provided for each numbered iron as is customary.

Figure 5:
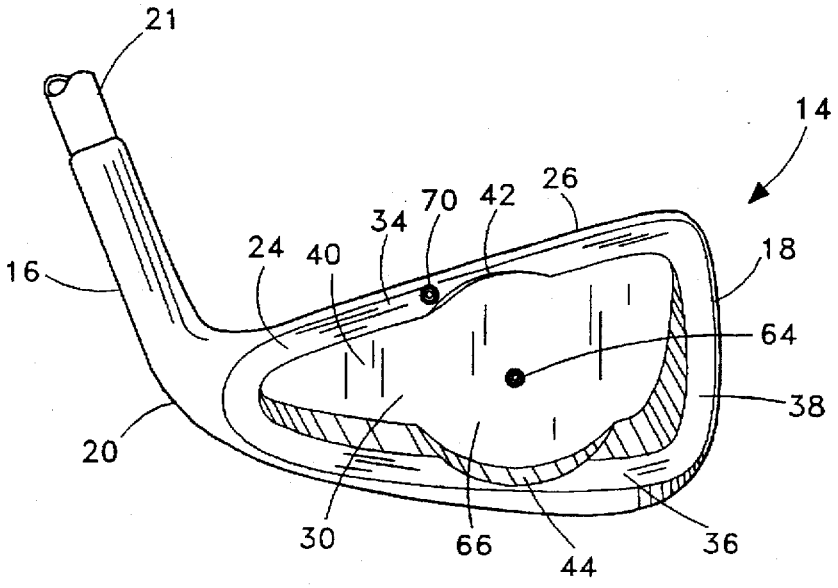
FIG. 5 is a rear elevational view of the club head of FIG. 1 with the balancing disk removed.

Referring specifically to FIG. 1 (and also to FIG. 5), it will be seen that the club head 14 has a cavity 30 formed in the rear face 24 thereof. Mounted within the cavity 30 is a balancing disk 32, the rotation of which, as will be described herein, provides for the adjustable balance nature of the golf club 12 of the present invention. The balancing disk 32 is positioned between and within an upper perimeter 34 and a lower perimeter 36. The solid outline as formed by the upper and lower perimeters (34 and 36), and by a toe end perimeter 38, constitute what is commonly referred to as "perimeter weighting," which is often present in modern golf clubs to give a larger sweet spot, as noted previously. The balancing disk 32 is rotatably mounted upon a cavity back wall surface 40 and resides within arcuate-shaped upper and lower recesses 42 and 44, respectively, that are formed in the upper and lower perimeters (34 and 36). To a certain degree, the upper and lower recesses (42 and 44) offer containment and stabilization of the balancing disk 32, and thereby, protection from inadvertent adjustment. The cavity back wall surface 40 against which the balancing disk 32 is flushly juxtaposed forms a plane that is parallel to the striking face 22. Thus, as is shown most clearly in FIG. 3, the balancing disk 32 of the preferred embodiment lies at an angle of inclination that is substantially identical to the striking face 22, although this will not always be the case, since some club heads are formed such that the front and rear surfaces are not parallel.

Referring again to FIG. 1, the preferred balancing disk 32 is comprised of a circular base portion 46 and a wedge portion 48 which are integrally fashioned together to form a structure that is "bi-level" in appearance. The balancing disk 32 has an eccentric weighting capability due to the wedge portion 48 which provides that more mass is present at an arcuate end 50 than at a vertex end 52. The amount of eccentric weighting offered by the balancing disk 32 can be easily varied by, among other possibilities, forming a balancing disk 32 with a narrower or wider wedge portion 48, by forming wedge portion sides 54 that are not straight as depicted, but rather arcuate, or by forming the wedge portion 48 with a wedge portion top surface 56 that slopes in some fashion from the vertex end 52 to the arcuate end 50, thereby increasing the mass differential of those two ends. Further, and particularly for aesthetic purposes, it may be desirable to internalize the eccentricity such that the exterior appearance of the balancing disk 32 is uniform (except for unobtrusive markings to indicate the location of the eccentric weighting).

Similarly, where a particular golfer's style of play requires a heavier or a lighter club head, the total mass of the balancing disk 32 may be varied, for example, by providing a thicker base and/or wedge portion (46 and/or 48), or by providing a balancing disk rear surface 58 (FIG. 4) that is either planar or hollowed, with a degree of concavity as corresponds to the amount of mass deemed desirable to be removed. The ability to alter the weight of the club head 14 in this manner has an especially useful application when a golfer wishes to exchange a club shaft made of graphite for one made of steel, or vice versa. Currently, a golfer who decides that he or she prefers, for example, steel over graphite, cannot have his or her golf clubs re-shafted and still maintain a proper swing weight. The weight can be brought into line by having available a second set of heavier or lighter balancing disks 32.

It will thus be seen, and as would be apparent to one with ordinary skill in the art, that there are a great number of shapes that might be employed for the balancing disk 32 in order to yield the desired eccentric and total weighting results. Therefore, it is not intended that the weighting system 10 be limited to a disk of the structure as depicted for the preferred embodiment presently known. By way of further example, the "wedge" portion 48 need not in fact be a wedge. The desired eccentric weighting could be provided by a second disk-shaped or other solid geometric structure fashioned off-center and on top of the base portion 46. Likewise, the base portion 46 need not be circular, i.e., the balancing "disk" 32 need not be a disk but could be some other geometric shape. Moreover, to achieve an eccentric weighting capability, it is not necessary, of course, that a bi-level structure be used. A purely wedge-shaped or other eccentrically weighted structure shape could be equally employed where that structure is rotatably or swingably mounted in a suitable fashion. A purely wedge-shaped weight, for example, also allows for more weight to be moved and redistributed about the club head 14. In the vein of the forgoing, it is important to note that an eccentric weight need not actually be employed to achieve an eccentric weighting capability. A weight of non-eccentric design may be used where that weight is mounted in an eccentric fashion. Thus, for example, a disk-shaped weight may be mounted off-center, and an elongated weight may be mounted so as to be biased towards one end in order to create the desired eccentric weighting and balancing upon rotation of such weights about their eccentric mounts.

Figure 4:
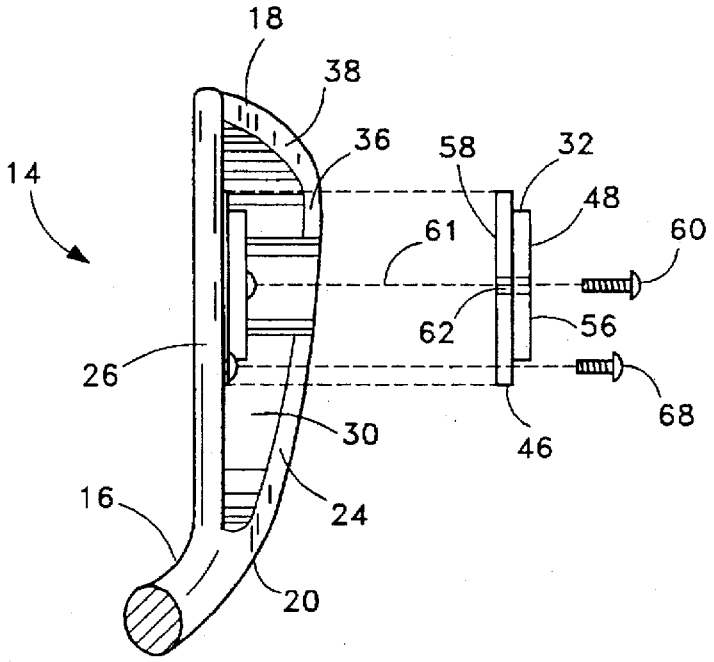
FIG. 4 is a top view of the club head of FIG. 1 showing an exploded view of the balancing disk.

Referring again to FIG. 1, and also to the top plan view provided by FIG. 4, as noted previously, the balancing disk 32 is rotatably mounted onto the cavity back surface 40. A first Allen screw 60 that passes through a centrally located aperture 62 (see FIG. 4) in the balancing disk 32 and that is screwed into a first threaded receiving hole 64 (see FIG. 5) present in a cavity back wall 66 provides this rotatable mounting. The first Allen screw 60 is of a length such that it may be screwably tightened within the first threaded receiving hole 64 without bearing down upon the wedge portion top surface 56. Thus, the first Allen screw 60 defines a center of rotation (origin) about which the balancing disk 32 is flee to rotate when adjustment is desired. Ideally, such a center of rotation is situated as close as possible to the original center of mass of the club head 14, with a rotation axis 61 for the balancing disk 32 being ideally perpendicular to the striking face 22. (This rotation axis 61 is shown in FIG. 4 as corresponding to the dashed line drawn to show the insertion manner of the first Allen screw 60.) This minimizes the number of balance parameters affected by rotation of the balancing disk 32.

In the weighting system 10 of the preferred embodiment, a second Allen screw 68 holds the balancing disk 32 in place during play. The second Allen screw 68 is screwed into a second threaded receiving hole 70 strategically located at a point in the upper perimeter 34 such that the head of the second Allen screw 68 is able to overlap and thereby bear down upon a base portion outer periphery 72, the thickness of the base portion 46 of the balancing disk 32 extending slightly beyond that of the upper perimeter 34 in order to accommodate this mode of holding. It should be noted, of course, that if the first Allen screw 60 is designed to be sufficiently snug, the second Allen screw 68 is made unnecessary. However, with respect to the iron club head 14 embodiment as shown, where access is not an issue, the extra security provided by the second Allen screw 68 is desirable. Not shown in the drawings is that it may also be desirable to introduce a rubber grommet or rubber washer behind the balancing disk 32 in order to reduce concussionatory vibrations that might otherwise cause a loosening of the balancing disk 32.

It must be noted that, for certain applications, the preferred embodiment of the present invention may in fact present a manner of adjustment that is actually too simple and easy for the golfer. Professional golf associations (e.g., the U.S.G.A.) may not allow a golf club which has a means of adjusting the balance that is as simple and expedient as that provided by the present invention, and which might possibly create an unfair advantage. In this case, the aforementioned Allen screws (60 and 68) might only be used for fitting purposes by a golf pro shop. That is, rotatable balancing disks 32 would be employed during a fitting to find the optimum position for the balance and weighting of the different club heads 14 as comprise a typical set of golf clubs 12, then the pro or fitter would "permanently" affix the balancing disks 32 (or perhaps a matching set of balancing disks 32 not provided with aperture 62) using, for example, an epoxy glue. If necessary, the balancing disks 32 could be reset at a later date using heat in a manner similar to re-shafting a golf club. Similarly, the adjustable balance weighting system 10 might be employed with a set of dubs used by a golf pro shop and designated for fitting purposes only. These "fitting clubs" would be used to optimize balance and weighting, and then a second set of playable golf clubs would be ordered from the factory manufactured to those specifications. Another possibility for limiting adjustability is to provide a "semi-permanent" mounting using screws which have a specially slotted screw head of a design not commonly available (similar to a TORX screw, for example). This would require the golfer to go back to the shop for adjustment. A semi-permanent mounting could also be achieved by requiring that two tools necessitating the use of two hands be needed to make any adjustment and wherein a third hand or a vice would then be necessary to hold the golf club 12 during the adjustment process.

Figure 6:
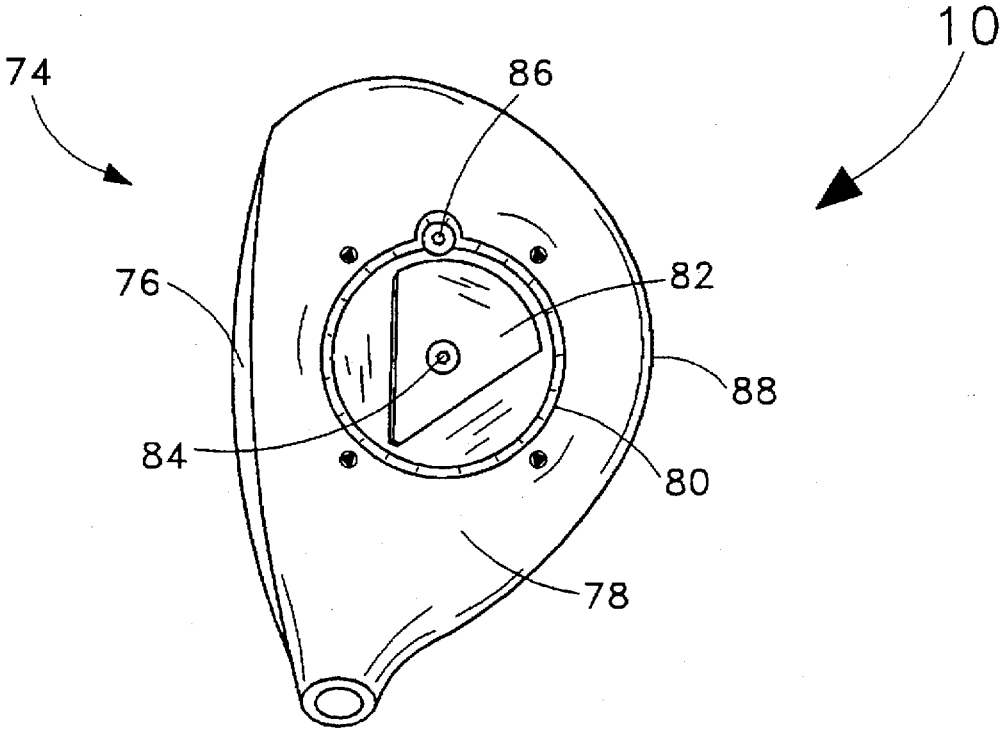
FIG. 6 is a top view of a wood-type club head incorporating the preferred embodiment of the present invention.
Figure 7:
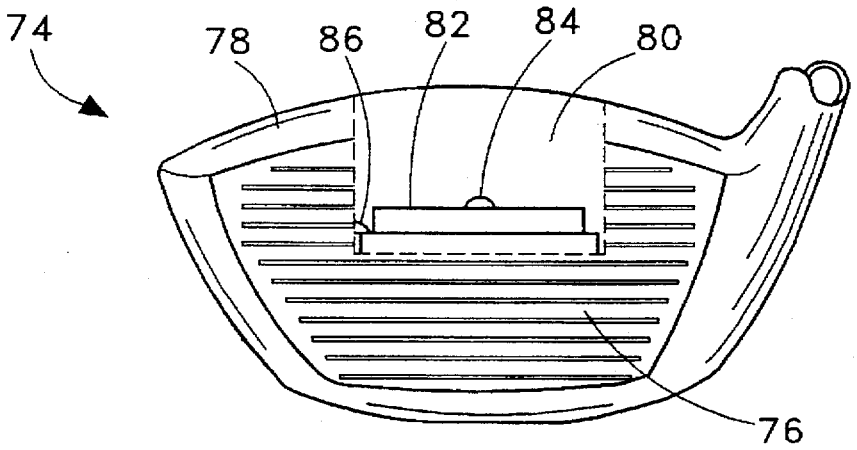
FIG. 7 is a front elevational view of the club head of FIG. 6 revealing the otherwise hidden recess within which the balancing disk is employed.

Shown in the top plan view of FIG. 6 and in the front elevational view of FIG. 7, is a wood-type club head 74 that also incorporates the weighting and balancing system 10 of the present invention. The club head 74 has attributes similar to those found in the iron-type club head 14, including a scored striking face 76. As is customary, the wood-type club head 74 departs from the iron-type club head 14 in having a much wider top surface 78. In this top surface 78 a recess 80 is provided within which a balancing disk 82 lies. The balancing disk 82 is of essentially identical construction to the balancing disk 32 of the iron-type dub head 14. The balancing disk 82 is also rotatably mounted in an essentially identical fashion to the balancing disk 32, the only difference being that the mounting has a horizontal, as opposed to vertical, orientation. As with the iron-type club head 14, first and second Allen screws 84 and 86 are used to provide both a rotational mounting axis and a hold down mechanism, respectively. The placement of the balancing disk 82 within the club head 74 is such as to closely correlate with the center of mass of the club head 74. A plug (not shown) made of wood or metal may be used to conceal the recess 80 and prevent the entry of dirt and other foreign matter therein.

In an alternative manner of so horizontally situating the balancing disk 82, it is contemplated that a horizontally oriented slot (not shown) may be provided for placement of the balancing disk 82 within the club head 74 instead of the recess 80. Such a slot would have a generally rectangular opening and be of a size to accommodate a sideways insertion of the thickness of the balancing disk 82. The opening of the slot would be located at the desired vertical elevation in a rear portion 88 of the club head 74 and the slot would extend horizontally within the club head 74. A slot of this nature reduces the amount of wood (or metal) that must be removed for placement of the balancing disk 82 within the club head 74, as compared to the embodiment which uses the recess 80, since the thickness of the balancing disk 82 is substantially smaller than that of the diameter of the balancing disk 82. Only a very narrow vertical shaft(s) centered in the club head 74 need then be provided for adjustment of an Allen screw(s).

Figure 8:
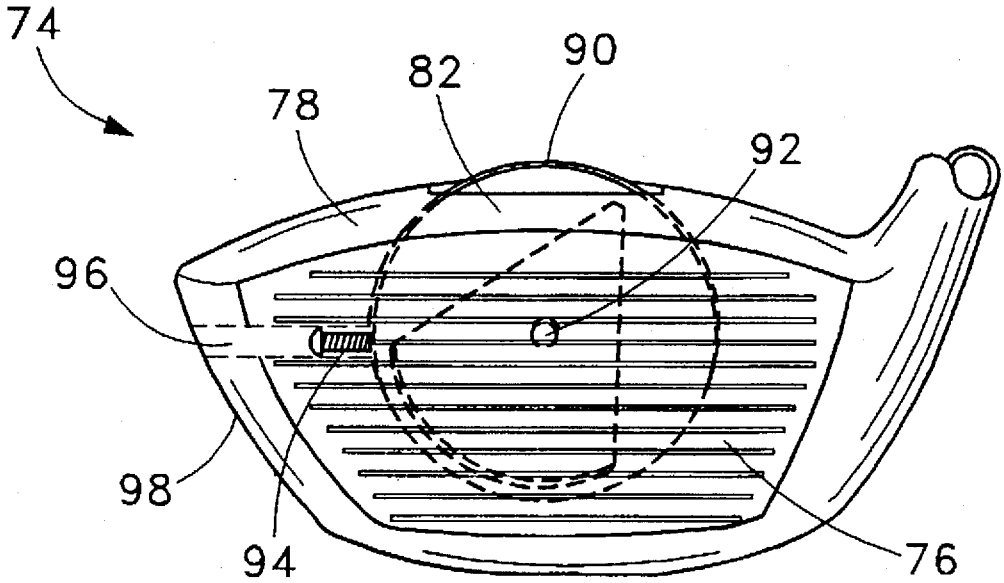
FIG. 8 is a front elevational view of a wood-type club head showing an alternative "thumbwheel" arrangement for the balancing disk.

Of course, the balancing disk 82 can also be mounted vertically on the rear portion 88 of the club head 74 in a manner similar to that previously described for the iron-type club head 14. In addition, and as is shown in the alternative embodiment of FIG. 8, a vertical mounting can be made within the club head 74 such that, for example, a balancing disk edge 90 is allowed to extend slightly above the top surface 78 in order to permit a "thumbwheel" type of adjustment. Such a vertically oriented balancing disk 82 rotates upon an axle 92. An Allen screw 94 located within a narrow shaft 96 is provided to be screwably tightenable against the balancing disk edge 90 to thereby hold the balancing disk 82 in position. The shaft 96 is shown as extending horizontally inward from a toe portion 98, but such a shaft could extend into the club head 74 from the rear portion 88 as well.

While in the drawings the iron- and wood-type club heads (14 and 74) are shown as employing only a single one of the balancing disks 32 (or 82), it is to be understood that more than one such balancing disk 32 (or 82) could be incorporated into either of the different club heads (14 and 74) and thereby provide a more complex weighting pattern and ability. For example, in the case of the iron-type club head 14, two balancing disks 32 could be mounted in side-by-side fashion on the cavity back surface 40, each balancing disk 32 being independently mounted and held. Likewise, two balancing disks 82 could be mounted on the wood-type club head 74, both in the top surface 78, or one in the top surface 78 and one vertically upon the rear portion 88.

It is to be further understood that the balancing disk 32 (the following applies in analogous fashion to the balancing disk 82 as well) may be rotatably mounted by a method other than by employment of either the aperture 62 within the balancing disk 32 or the first Allen screw 60. It would be apparent to one with ordinary skill in the art that a more permanent pin or rivet type of mounting might be employed in place of the first Allen screw 60, although the use of a fastener like an Allen screw allows for an easy removal and replacement by the golfer of the balancing disk 32 for purposes of conveniently modifying the total and/or eccentric weighting. Moreover, rotatable mounting of an eccentric weight such as the balancing disk 32 need not be accomplished with an aperture- and pin-type arrangement. The balancing disk 32 could also be retained by small brackets or arms that would extend from the cavity back surface 40 or from the upper and lower perimeters (34 and 36) of the iron-type club head 14, or from the top surface 78 of the wood-type club head 74, that would hold the base portion outer periphery 72 of the balancing disk 32 while still permitting rotation thereof. Portions of the upper and/or lower perimeters (34 and 36), or of the top surface 78, of the iron- and wood-type club heads (14 and 74), respectively, could also be made to be detachable and/or slotted to provide the desired rotatable retainment and also to allow for longitudinal movement as will be described immediately following.

It is to be understood that provision may be made for the mounting of the balancing disk 32 to allow for longitudinal adjustment in addition to the axial adjustability already described. For example, with appropriate lengthening oft he upper and lower recesses (42 and 44) of the iron-type club head 14, more than one first and/or second threaded receiving hole (64 and 70) could be employed to allow for longitudinal positioning of the balancing disk 32 at multiple sites towards or away from the toe and heel ends (18 and 20) of the club head 14, thereby providing a more biased balancing than could otherwise be achieved by simple rotation of an eccentric weight. The recess 80 of the wood-type club head 74 could be similarly adapted.

With either of the balancing disks (32 or 82), and with respect to any of the aforementioned embodiments of the weighting system 10, it is contemplated that a conventional ratcheting type of mechanism may be incorporated and used during the rotatable adjustment of the balancing disks (32 and 82) to provide for an especially precise, incremental adjustment.

The weighting system 10 of the preferred embodiment as presently known may be made from a variety of metals and metal alloys, such as steel and brass, or from combinations thereof. Other materials of sufficient density may also be employed to achieve the eccentric weighting and to provide the degree of corrosion resistance that is desired.

In addition to the above mentioned examples, it is to be understood that various other modifications and alterations with regard to the types of materials used, their method of joining and attachment, and the shapes, dimensions and orientations of the components as described may be made without departing from the invention. Accordingly, the above disclosure is not to be considered as limiting and the appended claims are to interpreted as encompassing the entire spirit and scope of the invention.

INDUSTRIAL APPLICABILITY

The weighting and balancing system 10 of the present invention is designed to be used with any type of golf club. Thus, any or all of the irons, woods and wedges (and putter) as comprises a set of golf clubs as is typically carded by a golfer may incorporate the weighting and balancing system 10. Use of the weighting and balancing system 10 is simple. Where the golfer finds in the course of a game or practice session that his or her swing is such as to tend to hook or slice the ball, correction with a golf club 12 of the iron type, for example, may be easily made by simply unscrewing the second Allen screw 68 and then rotating the balancing disk 32 about the rotation axis 61 towards or away from the toe end 18 or the heel end 20. A slice is subject to correction by rotating the balancing disk 32 so as to distribute more mass (i.e., the arcuate end 50 of the wedge portion 48) towards the toe end 18, while a hook is correctable by rotating the balancing disk 32 to move more mass toward the heel end 20. (The positioning of the balancing disk 32 as dram in FIG. 1 is so as to demonstrate the correction of a hook.) The only tool a golfer need carry to perform this adjustment is a small Allen wrench which can be conveniently kept in the golf bag, or attached thereto, at all times.

As noted previously, the weighting and balancing system 10, in relation to professional golfers especially, may also be used in the more permanent context of the fitting of golf clubs. The system 10 provides a much simpler method of determining the optimum balance and weighting for the manufacture or assembly of "permanently" adjusted golf dubs than is presently available, and thus the system 10 has an equally important application in this regard.

Because of the simplicity and convenience with which the weighting and balancing system of the present invention may be implemented, and for numerous other reasons as set forth previously herein, it is expected that the industrial applicability and commercial utility of the present invention will be extensive and long lasting.

What is claimed is:

1. In a golf club adapted to be utilized with a full swing, an iron or wood type golf club head having a front striking surface, a top surface and a rear surface, comprising:

eccentric weighting means for adjusting the balance and weight of the golf club, said eccentric weighting means including at least one eccentric weight, the at least one eccentric weight being of a non-dynamic character so as not to impart additional force to a golf ball when struck by said club head; and mounting means for rotatably mounting said eccentric weighting means upon at least one of said top and rear surfaces.

2. The golf club head of claim 1, wherein the eccentric weight includes a centrally located aperture for accommodating the rotatable mounting.

3. The golf club head of claim 1, wherein said mounting means includes a pin about which said eccentric weight may rotate.

4. The golf club head of claim 3, wherein the pin has the form of a screw.

5. The golf club head of claim 3, wherein said mounting means further includes at least one pin receiving hole in at least one of said top and rear surfaces.

6. The golf club head of claim 1, further including holding means for preventing rotation of said eccentric weighting means during play.

7. The golf club head of claim 6, wherein the holding means includes an Allen screw.

8. The golf club head of claim 1, wherein at least one of said top and rear surfaces includes a recess within which said eccentric weighting means may be located.

9. The system of claim 1, wherein the eccentric weight has the form of an eccentrically weighted disk.

10. In a golf club adapted to be utilized with a full swing, a method of adjusting the weight and balance of the associated club head, the club head being of iron or wood type having a front striking surface, a top surface, a rear surface, a toe and a heel, comprising the steps of:

providing at least one eccentrically balanced weight having a heavier portion and a lighter portion, said eccentrically balanced weight being of a non-dynamic character so as not to impart additional force to a golf ball when struck by said club head;

adjustably mounting said eccentrically balanced weight in rotatable fashion upon at least one of said top and rear surfaces; and rotatably orientating said eccentrically balanced weight such that the heavier portion is moved closer to said toe to correct a golfer's slice, and rotatably orientating said eccentrically balanced weight such that the heavier portion is moved closer to said heel to correct a golfer's hook.

11. The method of claim 10, wherein said eccentrically balanced weight has the general form of a disk.

12. The method of claim 10, wherein said eccentrically balanced weight further includes an aperture for receiving a pin to assist in the adjustable mounting thereby.

13. The method of claim 10, further including the step of permanently affixing the eccentrically balanced weight in the determined slice- or hook-correcting position.

* * * * *

UNITED STATES PATENT AND TRADEMARK OFFICE

CERTIFICATE OF CORRECTION

PATENT NO. : 5,683,309

DATED : November 4, 1997

INVENTOR(S) : Eric W. Reimers

It is certified that error appears in the above-identified patent and that said Letters Patent is hereby corrected as shown below:

Col. 1, l. 16; replace "hiring" with --hitting--;

Col. 2, l. 64; replace "carded" with --carried--;

Col. 5, l. 37; replace "flee" with --free--;

Col. 6, l. 18; replace "dubs" with --clubs--;

Col. 6, l. 43; replace "dub" with --club--;

Col. 7, l. 65; replace "oft he" with --of the--;

Col. 8, l. 35; replace "carded" with --carried--; and

Col. 8, l. 60; replace "dubs" with --clubs--.

Signed and Sealed this

Twenty-seventh Day of January, 1998

*Attest:*

Bruce Lehman

BRUCE LEHMAN

*Attesting Officer*

*Commissioner of Patents and Trademarks*